US006604276B2

(12) United States Patent
Jeong et al.

(10) Patent No.: US 6,604,276 B2
(45) Date of Patent: Aug. 12, 2003

(54) METHOD FOR FABRICATING A CHIP-TYPE VARISTOR HAVING A GLASS COATING LAYER

(75) Inventors: Jun Hwan Jeong, Younsu-ku (KR); Seung Chul Lee, Seodaemun-ku (KR); Hyun Choi, Koyang-si (KR)

(73) Assignee: Amotech Co., Ltd., Kyungki-do (KR)

( * ) Notice: Subject to any disclaimer, the term of this patent is extended or adjusted under 35 U.S.C. 154(b) by 0 days.

(21) Appl. No.: 09/839,492

(22) Filed: Apr. 23, 2001

(65) Prior Publication Data

US 2002/0109575 A1 Aug. 15, 2002

(30) Foreign Application Priority Data

Dec. 11, 2000 (KR) ..... 2000-75178

(51) Int. Cl.[7] ..... H01C 17/00; H01C 7/02; H01C 17/06; B05D 5/12

(52) U.S. Cl. ..... 29/610.1; 29/612; 29/620; 29/25.41; 427/79; 427/126.3

(58) Field of Search ..... 29/610.1, 611, 29/612, 619, 25.41, 620; 427/79, 126.3, 102, 103

(56) References Cited

U.S. PATENT DOCUMENTS 2,872,312 A * 2/1959 Eisenberg ..... 419/19
4,135,012 A * 1/1979 Su ..... 216/101
4,474,718 A * 10/1984 Mattox et al. ..... 264/235
5,198,788 A * 3/1993 Phillips et al. ..... 333/207
5,339,068 A * 8/1994 Tsunoda et al. ..... 338/308
5,866,196 A * 2/1999 Ueno et al. ..... 29/25.41
5,994,995 A * 11/1999 Ogasawara et al. ..... 257/536

FOREIGN PATENT DOCUMENTS

JP 06-096907 * 4/1994 ..... H01C/7/10
JP 06-124807 * 5/1994 ..... H01C/7/10

* cited by examiner

*Primary Examiner*—Carl J. Arbes
*Assistant Examiner*—Thiem D Phan
(74) *Attorney, Agent, or Firm*—Rosenberg, Klein & Lee

(57) ABSTRACT

A ceramic chip-type device having a glass coating film and a fabricating method thereof are provided, in which a coating film having an excellent acid-resistant property is formed on the surface of the ceramic chip device. Thus, the ceramic chip-type device having a glass coating film stands an attack due to a flux at the time of reflow soldering, to thereby maintain an initial insulation resistance. The ceramic chip-type device is made of a ceramic passive device chip including a pair of external electrode terminals on either end of the ceramic chip-type device, and a glass coating film of an excellent acid-resistant property formed on the surface of a ceramic body located between the pair of external electrode terminals.

7 Claims, 8 Drawing Sheets

METHOD FOR FABRICATING A CHIP-TYPE VARISTOR HAVING A GLASS COATING LAYER

BACKGROUND OF THE INVENTION

1. Field of the Invention

The present invention relates to a ceramic chip-type device having a glass coating film and a fabricating method thereof, and more particularly, to a chip-type varistor having a glass coating film and a fabricating method thereof, in which a coating film having an excellent acid-resistant property is formed on the surface of the ceramic chip-type device, to thus stand an attack due to a flux at the time of reflow soldering, to thereby maintain an initial insulation resistance.

2. Description of the Related Art

Recently, a variety of portable electronic equipment such as mobile telecommunication terminals becomes more compact in size. Accordingly, circuitry components used in such portable electronic equipment become also more compact and integrated in high density. As a result, each component is designed to have a low rating voltage and current.

In general, a varistor is a resistor element having a non-linear voltage/current characteristic. A large-capacity varistor for protecting a lightening arrester or a voltage transformer from an applied overvoltage has a structure in which a SiC fuse is inserted between both electrodes. Meanwhile, a compact small-capacity varistor which can react upon a relatively low voltage/current quickly has a structure in which a pair of conductor patterns connected to both electrodes are embedded in the ceramic material.

Meanwhile, when a chip-type varistor fabricated for use in a SMD (Surface Mounting Device) is mounted on a PCB (Printed Circuit Board) 3 using reflow soldering, both electrodes 9*a* and 9*b* of the chip varistor 1 contact solder pastes 5 and the bottom surface of the chip varistor 1 is eroded by a flux 7 as shown in FIG. 1A.

In general, a solder paste which is used for reflow soldering of a mounting chip component for a SMD uses a flux in order to enhance a soldering performance. The flux contains $Cl^-$ ion components, which play a role of removing foreign matters, dirts, oxides, and so on which exist on the device surface or external electrodes during soldering.

However, the flux component is activated in a reflow oven during soldering, and then a liquefied flux moves to between the PCB 3 and the chip varistor 1 as shown in FIG. 1B, to accordingly erode the surface of the chip varistor, particularly, a grain boundary 1*a*. Thus, the flux component attacks the surface of the chip varistor device during soldering, and dissolves ZnO and $Sb_2O_3$ having a low acid-resistant property among main constituents such as ZnO, $Bi_2O_3$, and $Sb_2O_3$. As a result, excessive Zn and Sb ions are made to exist in the flux.

The flux containing metal of the ionic phase forms another current flowing path between both the electrodes 9*a* and 9*b* in the chip varistor 1. Accordingly, after reflow soldering, an initial insulation resistance value of the chip varistor 1 falls down from several hundred Mω through several Gω to several hundred Kω through several Mω abruptly.

Further, in the case of a conventional chip varistor fabrication process, an external electrode terminal connected to an internal electrode terminal is formed and then the surface of the external electrode terminal is plated with metal such as Cu, Ni, and Sn.

Meanwhile, a general chip varistor is a product using a semiconductor property of a ZnO ceramic material, which plays a role of a non-conductor at normal state, but of a conductor at threshold voltage or higher. Thus, during electroplating of the chip varistor, the ceramic body is altered into a conductor and thus the surface of the ceramic body is plated. As a result, a bridging phenomenon that both external electrodes are connected each other may occur. Such a bridging phenomenon causes leakage of current to thereby provide a malfunction factor.

Further, since low voltage driving circuits are widely used recently, if an insulation resistance of a certain chip component falls down to a threshold value or less, an excessive current flows to thereby cause the circuit not to operate.

SUMMARY OF THE INVENTION

To solve the above problems, it is an object of the present invention to provide a chip-type varistor having a glass coating film preventing a bridging phenomenon during electroplating of external electrodes and a fabricating method, in which a coating film having an excellent acid-resistant property is formed on the surface of the ceramic chip device, to thus stand an attack due to a flux at the time of reflow soldering, to thereby maintain an initial insulation resistance.

It is another object of the present invention to provide a chip-type device fabricating method for forming a glass coating film on the surface of a general chip-type passive device and a ceramic chip device therefor in addition to the above chip varistor.

To accomplish the above object of the present invention, there is provided a chip-type varistor for maintaining an initial insulation resistance during soldering, the chip-type varistor comprising: a varistor chip in which a number of conductive pattern layers are stacked between the upper and lower portions in a ceramic body which are spaced by a predetermined distance, and whose both ends are withdrawn in either lateral direction in turn to thereby form first and second inner electrodes; a pair of first outer electrodes each surrounding either end of the varistor chip so as to be electrically connected to the first and second inner electrodes, respectively; and a glass coating film formed of an excellent acid-resistant material on the surface of the ceramic body in order to avoid erosion with respect to a grain boundary of the ceramic body surface due to a flux during soldering to thereby maintain the initial resistance.

The glass coating film can be extensively formed on the whole surface of the varistor chip. Also, the chip-type varistor further comprises a pair of second outer electrodes surrounding the pair of the first outer electrodes, respectively.

According to a first aspect of the present invention, there is also provided a method for fabricating a chip-type varistor having a glass coating film, the chip-type varistor fabrication method comprising the steps of: (a) preparing a varistor chip whose both ends are withdrawn in either lateral direction in turn to thereby form first and second inner electrodes, in which a number of conductive pattern layers are stacked between the upper and lower portions in a ceramic body which are spaced by a predetermined distance; (b) forming a pair of first outer electrodes each surrounding either end of the varistor chip so as to be electrically connected to the first and second inner electrodes, respectively; (c) forming a mask for preventing glass from being penetrated toward the inner electrodes in which polymer is used on the lower ends of the first outer electrodes; (d) after dipping the first outer electrodes into a glass-added paste, flowing the glass included in the paste onto the surface of the ceramic body by a thermal treatment to thereby form the glass coating film and simultaneously removing a face portion formed outside the mask so as to expose the first outer electrodes; and (e) forming a pair of second outer electrodes surrounding the pair of the first outer electrodes, respectively on either end of the chip.

According to a second aspect of the present invention, there is also provided a method for fabricating a chip-type varistor having a glass coating film, the chip-type varistor fabrication method comprising the steps of: (a) preparing a varistor chip in which a number of conductive pattern layers are stacked between the upper and lower portions in a ceramic body which are spaced by a predetermined distance, and whose both ends are withdrawn in either lateral direction in turn to there by form first and second inner electrodes; (b) dipping the varistor chip into a weak acid solution to thereby form a number of pores on the surface of the ceramic body; (c) after fully dipping the varistor chip into a glass slurry formed of glass powder, rotating and drying the chip so as to process the glass slurry coated on the surface of the chip to have a constant thickness; thermally treating the glass slurry coated chip to thereby melt the glass in the pores on the chip surface, and form a uniform glass coating film by a capillary phenomenon; and (d) forming respectively outer electrodes surrounding the glass coating film corresponding to the inner electrodes, on either end of the chip.

In this case, the glass-added paste is made of adding any one of $SiO_2$+RO, $B_2O_3$+RO and $SnO_2$+RO by 0.1–100 wt % to any one metal powder among Ag, Ag/Pt, Ag/Pd, Ag/Pd/Pt, Ag/Au and Ag/Au/Pt, in which RO is made of a mixture of one through five kinds of materials selected from the group consisting of PbO, $Bi_2O_3$, $SiO_2$, $Al_2O_3$, ZnO, $P_2O_5$, MgO, $Na_2O$, BaO, CaO, $K_2O$, SrO, $Li_2O$, $TiO_2$, $ZrO_2$, $V_2O_5$ and $SnO_2$.

Also, it is preferable that the glass slurry comprises powders made of $SiO_2$, $Al_2O_3$, CaO, $Na_2O$, $B_2O_3$ and PbO, as a main component.

In this case, the outer electrode formation step comprises the steps of preliminarily forming the outer electrodes using a paste made of metal powder of 91–96 wt %, binder of 3 wt %, and glass of 1–5 wt %; and thermally treating the preliminary formed outer electrodes at 600–800° C.

According to a third aspect of the present invention, there is also provided a method for fabricating a chip-type varistor having a glass coating film, the chip-type varistor fabrication method comprising the steps of: (a) pattern-printing an inner electrode formation conductive paste on a number of ceramic substrates to thereby prepare a number of inner electrode layers; (b) forming a pair of glass-added sheets in which glass is added to the same ceramic substrate as the above composition by 0.1–10 w %; (c) after collating, laminating and compressing the pair of glass-added sheets and undergoing a chip cutting in which the pair of glass-added sheets are used as upper and lower cover sheets for the inner electrode layers, sintering the glass components of the glass-added sheets in liquid phase in advance by performing burn-out and cofiring a binder, and then forming a glass coating film on a grain boundary of a ceramic body; and (d) after passing through a tumbling process, forming outer electrode terminals on either end of the chip.

Further, according to the present invention, there is also provided a ceramic chip-type device having a glass coating film, the ceramic chip-type device comprising: a ceramic passive chip including a pair of external electrode terminals on either end of the ceramic chip-type device; and a glass coating film of an excellent acid-resistant property formed on the surface of a ceramic body located between the pair of external electrode terminals.

As described above, glass having the excellent acid-resistant property is coated on the surface of the chip-type varistor in the present invention, to thereby prevent erosion of the chip-type varistor due to an activated liquified flux during reflow soldering. As a result, the present invention in which the glass coating film is formed can exclude an effect of the flux, to thereby maintain a high initial insulation resistance value.

Also, it is possible to remove a bridging phenomenon since the glass coating film protects the surface of the chip-type varistor from a plating solution during electrolytic plating.

BRIEF DESCRIPTION OF THE DRAWINGS

The above objects and other advantages of the present invention will become more apparent by describing the preferred embodiment thereof in more detail with reference to the accompanying drawings in which.

DETAILED DESCRIPTION OF THE INVENTION

Preferred embodiments will be described below in more detail with reference to the accompanying drawings.

Figure 4:
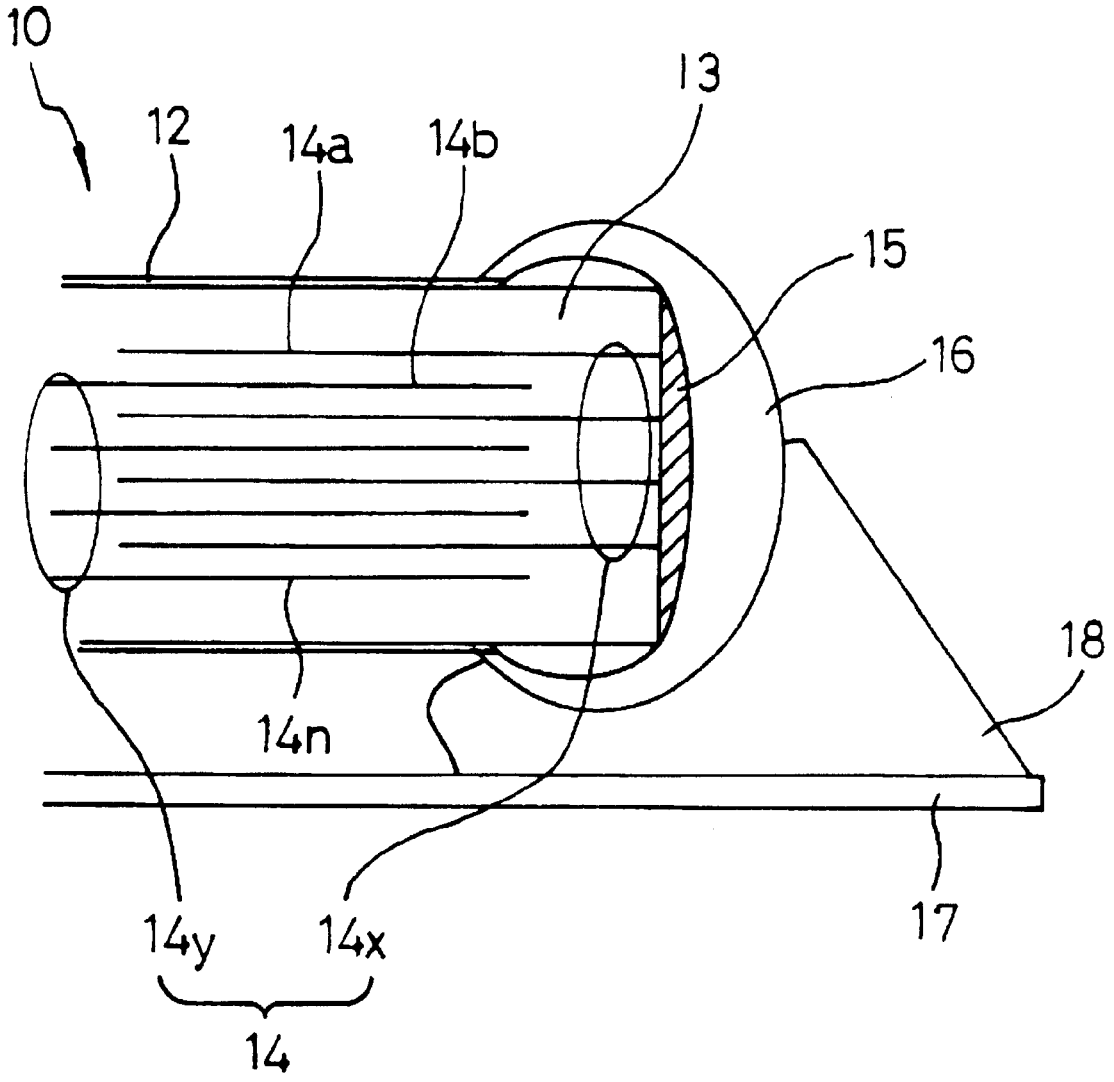
FIG. 4 is a sectional view in the case that reflow soldering is performed using a chip-type varistor obtained by the first embodiment method.
Figure 6:
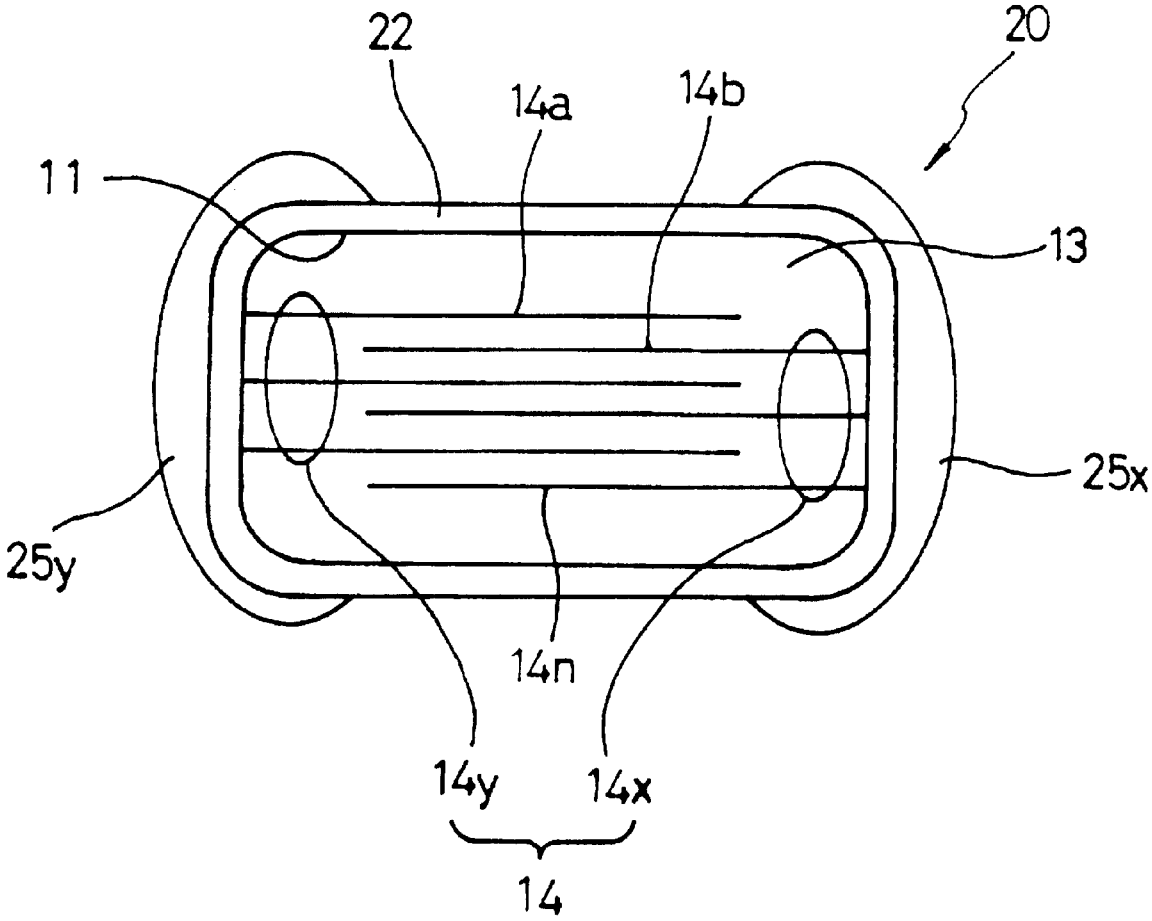
FIG. 6 is a sectional view showing a chip-type varistor obtained by the second embodiment method.

First, in the case of a chip-type varistor 10 according to a first embodiment of the present invention as shown in FIG. 4, a glass coating film 12 is formed on the surface of a ceramic body 13 in a varistor chip 11 of FIG. 6. A number of conductive pattern layers 14*a*–14*n* are stacked between the upper and lower portions in the ceramic body 13 which are spaced by a predetermined distance, to thereby form an inner electrode 14.

Also, the inner electrode 14 whose both ends are withdrawn in either lateral direction in turn to thereby form first and second inner electrodes 14*x* and 14*y*. The two electrodes 14*x* and 14*y* are surrounded by first and second outer electrodes 15 and 16, respectively, so as to be electrically connected to the outer electrodes.

In this case, the glass coating film 12 can be formed of any one of excellent acid-resistant materials.

For example, any one material having a composition illustrated in the following Table 1 can be used, which preferably melts between about 600–800° C. The reason is because a cofiring process of inner electrode 14 and the ceramic body 13 is executed between 1000–12000° C. during fabricating a varistor, glass having a low melting point which does not affect the cofiring process is appropriate.

TABLE 1

| Kind of glass | Kind of paste | Glass frit content (wt %) |
|---|---|---|
| $SiO_2$ + RO<br>$B_2O_3$ + RO<br>$SnO_2$ + RO | Ag, Ag/Pt,<br>Ag/Pd, Ag/Pd/Pt,<br>Ag/Au, Ag/Au/Pt | 0.1–100 |

The RO is made of a mixture of one through five kinds of materials selected from the group consisting of PbO, $Bi_2O_3$, $SiO_2$, $Al_2O_3$, ZnO, $P_2O_5$, MgO, $Na_2O$, BaO, CaO, $K_2O$, SrO, $Li_2O$, $TiO_2$, $ZrO_2$, $V_2O_5$ and $SnO_2$.

The glass coating film 12 formed on the surface of the varistor chip 11 has an excellent acid-resistant property in general which would not erode by an erosive acid material, and a high insulation resistance feature.

Thus, since the surface of the varistor 10 having the glass coating film 12 as shown in FIG. 4 is completely surrounded by the glass coating film 12, the varistor 10 is prevented from eroding due to an activated liquified flux during reflow soldering. In FIG. 4, a reference numeral 17 denotes a printed circuit board (PCB) on which the varistor 10 is mounted and a reference numeral 18 denotes a solder.

As a result, the glass coated chip-type varistor 10 has no flux influence, to thereby maintain a high insulation resistance value.

The first and second outer electrodes 15 and 16 play a role of an intermediate layer between the solder 18 and a parent material or metal at a soldering process for mounting a SMD chip-type varistor 11 on the PCB 17. Basically, the outer electrodes 15 and 16 are connected to the inner electrodes 14 through a firing process, to thereby play a direct role of connecting an electrical characteristic obtained in the filler with an external circuit, in which case the outer electrodes 15 and 16 are combined with the solder during performing a SMD mounting process and fixed to a proper position, to operate as semi-permanent components in the circuit.

A currently chiefly used outer electrode 16 is made of one of Ag, Ag/Pt, Ag/Pd, Ag/Pd/Pt, Ag/Au, Ag/Au/Pt and so on, which is selected from the group sufficing the size of a product, a characteristic of the parent metal, and a solderability. Even in the case that the outer electrodes are used for another object, the outer electrodes have a basic purpose of connecting the circuitry characteristic embodied by the inner electrodes 14 to the external circuit, which is not used for soldering directly but is used as a base for a plating process. As a plating technology is developed, the outer electrodes are both fabricated in this direction.

Processes of forming a glass coating film and outer electrodes according to a first embodiment of the present invention will be described below with reference to FIGS. 2 through 3F.

Figure 3A:
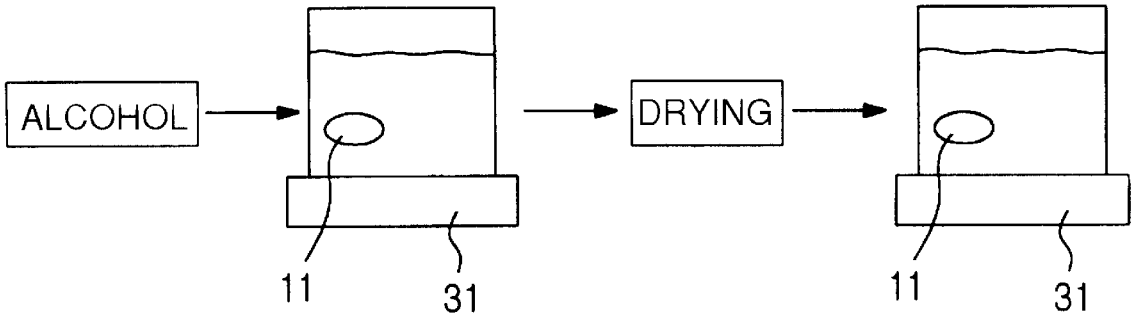
FIGS. 3A through 3F are sectional views showing a glass coating film formation process proceeding according to the FIG. 2 flowchart view.

First, at the state where a varistor chip 11 has been prepared by a batch process, the varistor chip 11 is ultrasonically washed for five minutes by an ultrasonic washing basin 31 by using a weak acid solution or an alcoholic group solvent primarily according to a chip washing process S1 shown in FIG. 3A, and then dried. Thereafter, another ultrasonic washing using HCl of 3–10% solution is performed for 1–5 minutes, to then etch the chip surface and remove foreign matters from the chip surface.

Figure 3B:
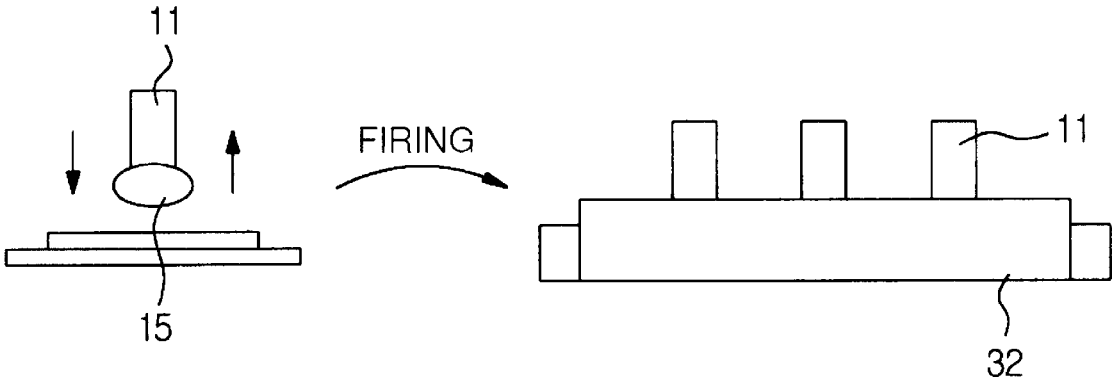

Then, as shown in FIG. 3B, a paste containing an electrode material having a low specific resistance is deposited on only both ends of the chip with a dipping method, in order to smoothen an electrical conductivity with respect to the inner electrodes 14, to thereby form first outer electrodes 15 preliminarily (S2).

Thereafter, as a firing process, the first outer electrodes 15 are heated and processed in a belt furnace 32 of FIG. 3B, at an appropriate temperature, for example, at approximately 800° C., in order to remove organic matters added in the first outer electrodes 15, and perform adhesion to the parent metal and connection to the inner electrodes 14 (S3).

Figure 3C:
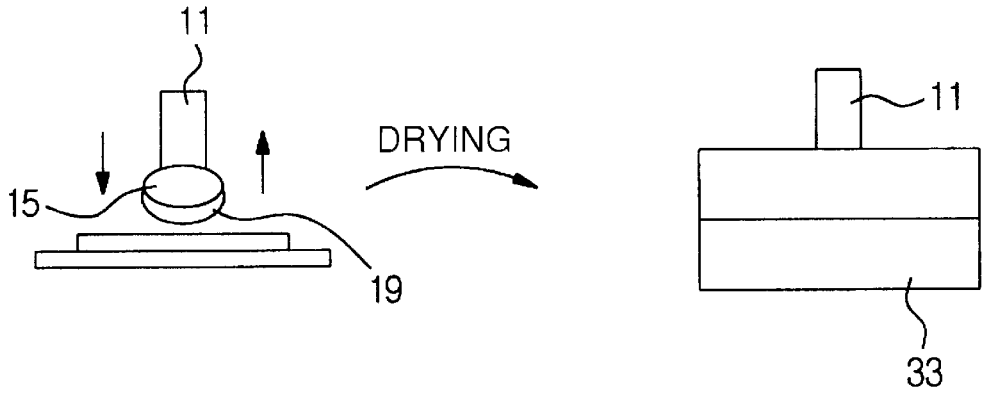

Then, as shown in FIG. 3C, a barrier is formed by using a polymer 19 so as to be coated on the lower surfaces of the first outer electrodes 15 in order to prevent glass to be coated in a post-process from being penetrated toward the inner electrodes 14, and then a masking process S4 for drying the barrier is performed in a drying oven 33.

Figure 3D:
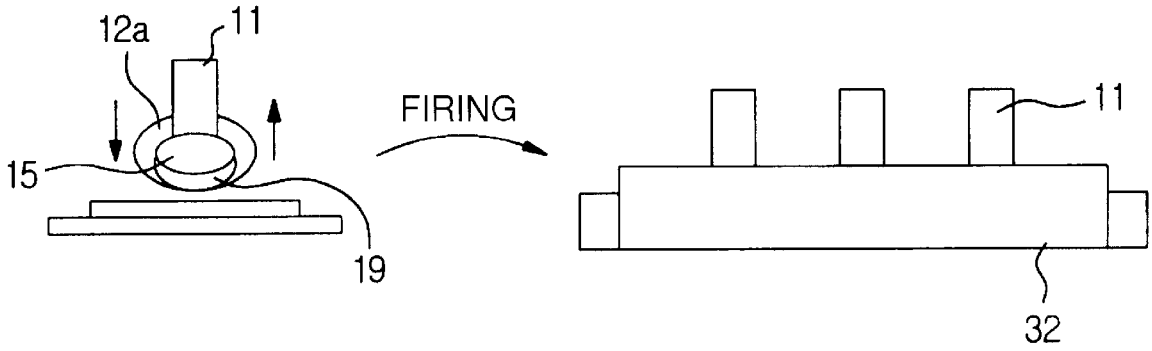

Then, in order to improve an insulation resistance, a glass frit using one of the glass kinds indicated in Table 1 is mixed with one of metal powders among the conductive electrode material powers indicated in Table at a ratio of 0.1–100 wt %, to thereby make a paste, and then as shown in FIG. 3D both ends of the varistor chip 11 is dipped in the glass-added paste and thus the glass-added paste is coated on both the ends of the varistor chip 11 (S5).

Then, the chip is fired by using the belt furnace 32, so that the glass in the paste 12*a* flows well so as to be coated on the surface of the chip (S6). The glass component added in the paste 12*a* has a high wetting property in the case of the thermal treatment. Thus, if the glass has a flowing mobility at a predetermined temperature or higher, the glass flows toward the surface of the parent metal. As a result, the glass coating film 12 is coated on the surface of the chip uniformly.

Figure 3E:
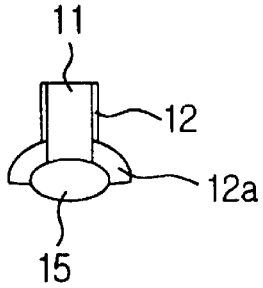

Also, in the firing process, the leading end of the masking processed polymer 19 falls off in order to block penetration of the glass toward the inner electrodes 14, to thereby obtain the shape shown in FIG. 3E (S7). That is, the masking portions of both ends of the chip are removed so that final second outer electrodes 16 can be completely combined with the first outer electrodes 15.

Then, the paste obtained by mixing the metal powder and the glass powder (that is, the glass frit) is used as shown in Table 1, by using the outer electrode material composition selected considering the final electrical property and solderability, to thereby perform a preliminary forming for the outer electrodes 16 at the mask-removed portions (S8) In this case, the outer electrode material composition can be set, for example, metal powder of 96 wt %, binder of 3 wt %, glass of 1 wt %. It is preferable that the glass content can be used up to at maximum 5 wt %.

Finally, the second outer electrodes 16 are fired in the belt furnace 32, at an appropriate temperature, for example, at approximately 600° C.–800° C., in order to remove organic matters added in the second outer electrodes 16, and perform adhesion to the parent metal and connection to the inner electrodes 14 (S9).

Thus, as shown in FIG. 4, the glass component added in the paste 12*a* has a high wetting property in the process of forming the glass coating film 12. Thus, if the glass has a flowing mobility at a predetermined temperature or higher, the glass flows toward the surface of the filler. As a result, the glass coating film 12 is coated on the surface of the chip.

In the case of the process of forming the glass coating film according to the first embodiment, the first outer electrode forming process S2 and the firing process S3 are omitted, and the post-processes can proceed from the masking process S4.

Hereinbelow, a chip type varistor having a glass coating film on the surface of the chip according to a second embodiment of the present invention will be described in more detail with reference to FIGS. 5 and 6.

Figure 5:
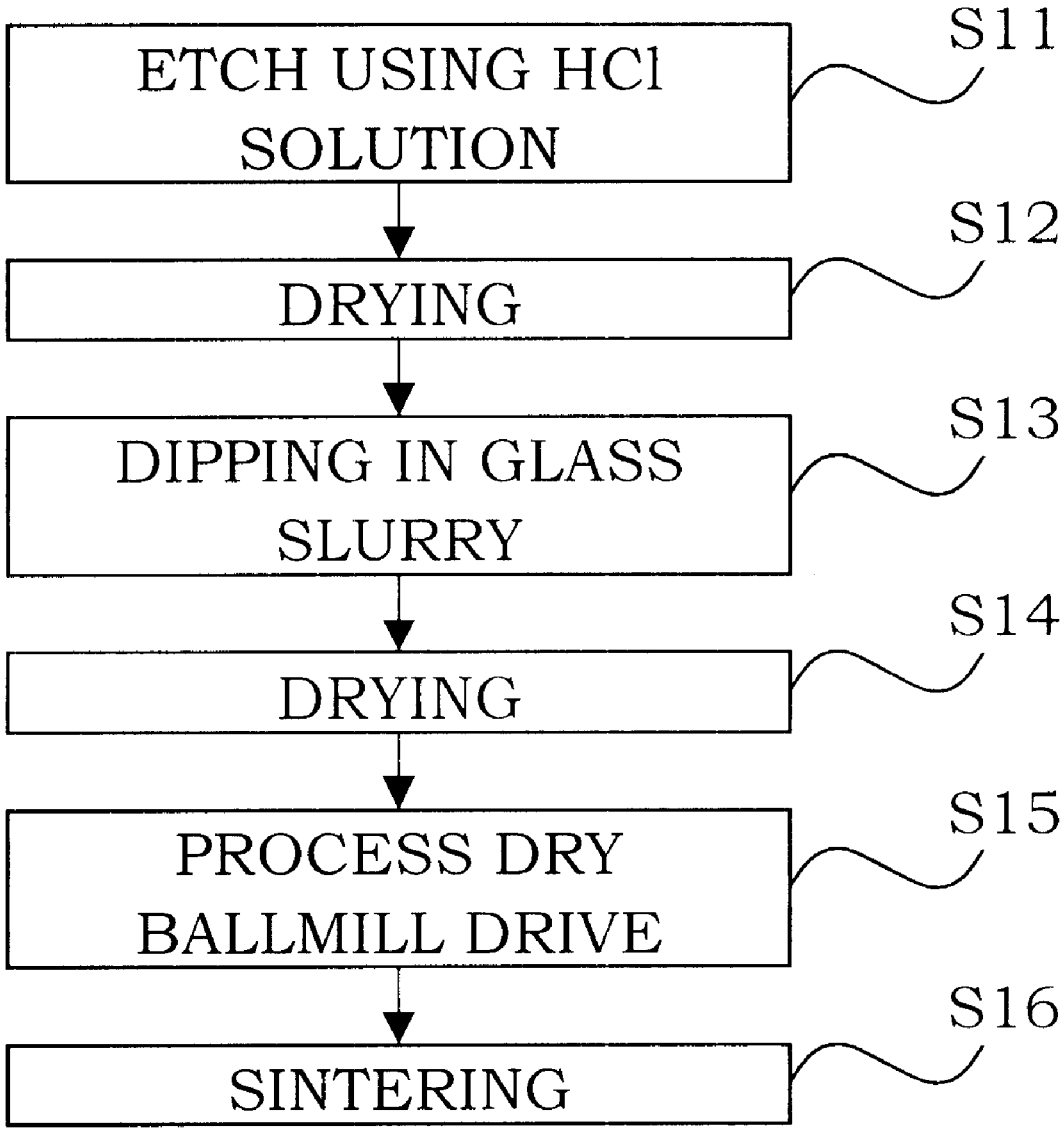
FIG. 5 is a flowchart view illustrating a method for forming a glass coating film on the surface of a chip-type varistor according to a second embodiment of the present invention.

FIG. 5 is a flowchart view illustrating a method for forming a glass coating film on the surface of a chip-type varistor according to a second embodiment of the present invention. FIG. 6 is a sectional view showing a chip-type varistor obtained by the second embodiment method.

First, referring to FIG. 6, in the case of the chip-type varistor 20 according to the second embodiment of the present invention, a glass coating film 22 is formed on the surface of a ceramic body 13 in a varistor chip 11. A number of conductive pattern layers 14*a*–14*n* are stacked between the upper and lower portions in the ceramic body 13 which are spaced by a predetermined distance, to thereby form inner electrode 14.

Also, the electrode 14 whose both ends are withdrawn in either lateral direction in turn to thereby form a respective group to form first and second inner electrodes 14*x* and 14*y*. The two inner electrodes 14*x* and 14*y* are surrounded by two outer electrodes 25*x* and 25*y*, through the glass coating film 12, respectively, so as to be electrically connected to the outer electrodes.

In this case, the glass forming the glass coating film 22 can be formed of any one of excellent acid-resistant materials. That is, one of compounds indicated in the following Table 2 can be used as the glass.

TABLE 2

| | $SiO_2$ | $Al_2O_3$ | CaO | MgO | $Na_2O$ | $K_2O$ | $B_2O_3$ | PbO | etc. |
|---|---|---|---|---|---|---|---|---|---|
| Composition 1 | 3 | 1 | 2 | | 2 | | 2 | 4 | |
| Composition 2 | 4 | 2 | 2 | | 2 | 1 | 2 | 3 | |
| Composition 3 | 4 | 2 | 2 | 1 | 2 | 1 | 3 | 3 | |

Figure 1A:
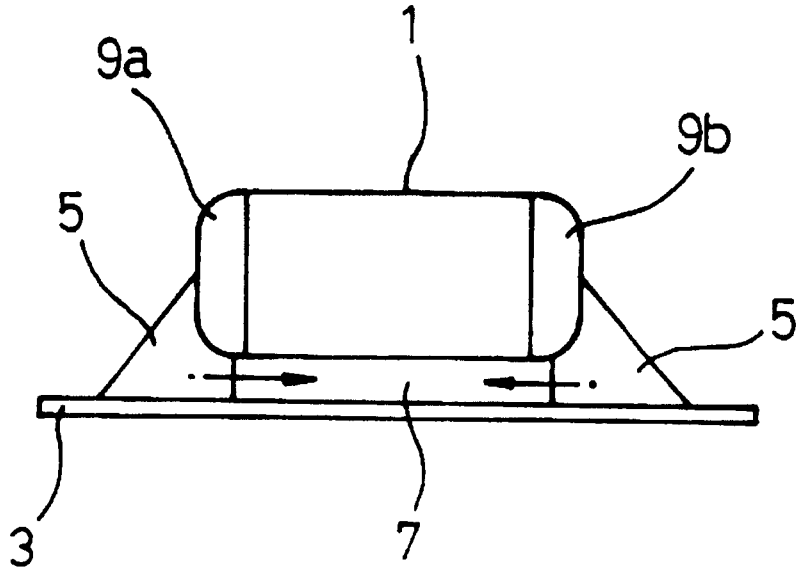
FIG. 1A (PRIOR ART)
FIGS. 1A and 1B are partially enlarged views for explaining an erosive action of a conventional chip-type varistor due to a flux when the chip-type varistor is reflow-soldered and an insulation resistance reduction factor, respectively.
Figure 1B:
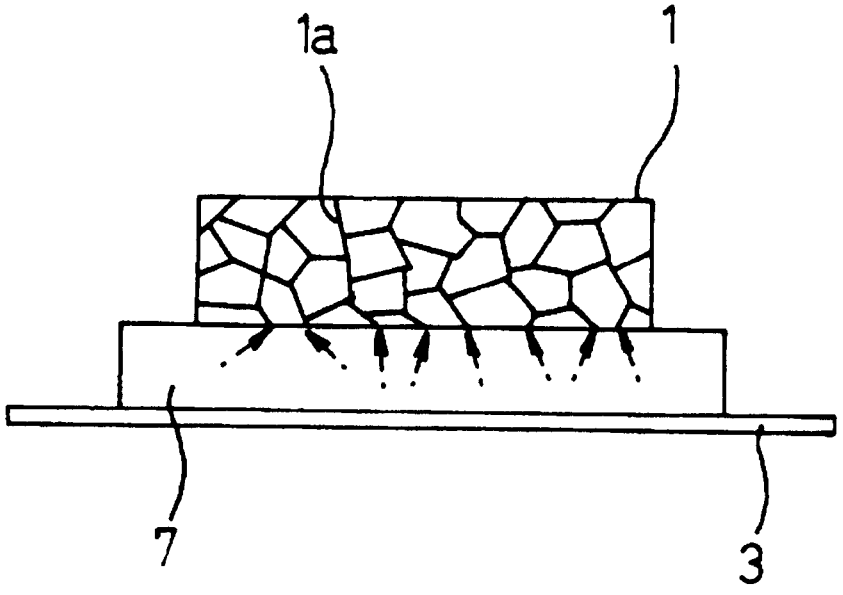
FIG. 1B (PRIOR ART)
Figure 2:
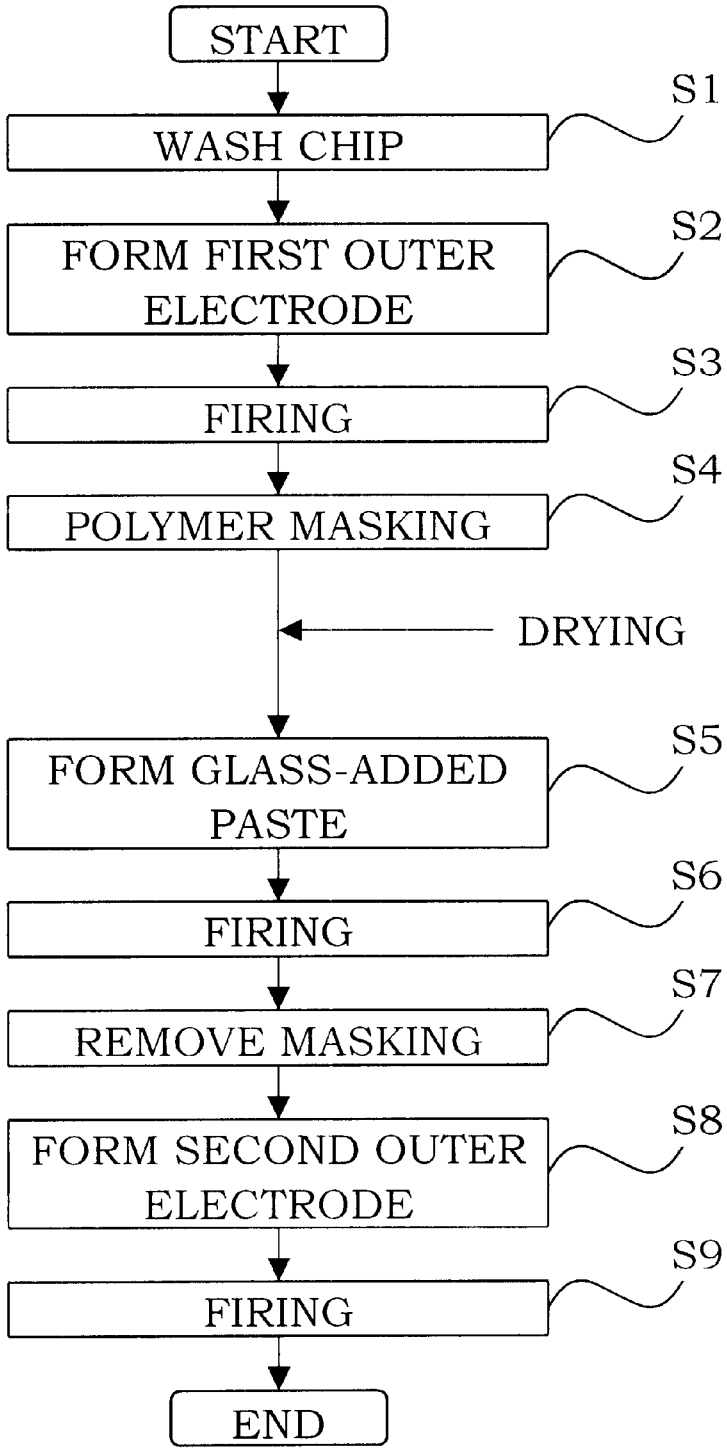
FIG. 2 is a flowchart view illustrating a method for forming a glass coating film on the surface of a chip-type varistor according to a first embodiment of the present invention.
Figure 3F:
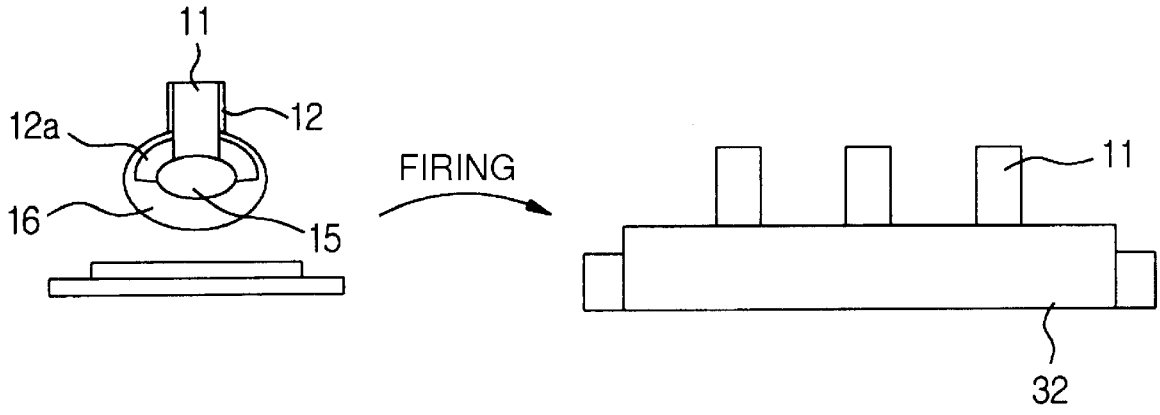

In the above Table 2, FIG. 1 means the content of 0.1–3%, FIG. 2 means the content of 3.1–10%, FIG. 3 means the content of 10.1–40%, and FIG. 4 means the content of 40% or more.

As a result, the glass coating film 22 formed on the surface of the varistor chip 11 has an excellent acid-resistant property in general which would not erode by a strong erosive acid material, and a high insulation resistance feature.

Thus, since the surface of the varistor chip 11 is completely surrounded by the glass coating film 22, the varistor chip 11 is prevented from eroding due to an activated liquified flux during reflow soldering. As a result, the glass-coated varistor 20 has no influences from the flux, to thereby maintain a high insulation resistance value.

Processes of forming a glass coating film and outer electrodes according to a second embodiment of the present invention will be described below in detail with reference to FIGS. 5 and 6.

First, at the state where a varistor chip 11 has been prepared by a batch process, the varistor chip 11 is dipped into a HCl solution of 1–30% for from one minute to twenty-four minutes according to a chip etching process S11, and then ultrasonically washed by water and then dried (S12). In this case, the above etching process is undergone, to form a number of pores on the surface of the chip 11.

Then, in order to improve an insulation resistance, a glass powder is mixed with water among the glass composition examples 1–3 indicated in Table 2 at a ratio of 2 to 3, to thereby make a glass slurry, and then the varistor chip 11 is completely dipped in the glass slurry for from one to ten minutes and thus the glass slurry is coated on both the surface of the varistor chip (S13 and S14).

Thereafter, the chip on the surface of which the glass slurry is coated is put into a dry ball mill drive and processed. The dry ball mill drive is rotated so that the chips are not adhered to one another. At the same time when the chip is dried, it is processed to have a uniform thickness of the glass slurry coated on the chip surface (S15).

Then, if the chip is heated and plastered at approximately 600° C.–800° C., the glass is melted, to thereby form a uniform glass coating film 22 on the surface of the chip, by a capillary phenomenon.

Finally, likewise the first embodiment, a paste containing an electrode material having a low specific resistance is coated on only both ends of the chip with a dipping method, in order to smoothen a electrical conductivity with respect to the inner electrode 14, to thereby form outer electrodes 25*x* and 25*y*), and then if a firing process is undergone, to thereby obtain a structure shown in FIG. 6.

Thus, using a simple process, since the surface of the varistor chip 11 is completely surrounded by the glass coating film 22 in the varistor 20 according to the second embodiment, the glass-coated varistor 20 has no influences from the flux, to thereby maintain a high insulation resistance value.

A varistor on the surface of which a glass coating film is coated and a method therefor according to a third embodiment of the present invention will be described below in detail with reference to FIG. 7.

Figure 7:
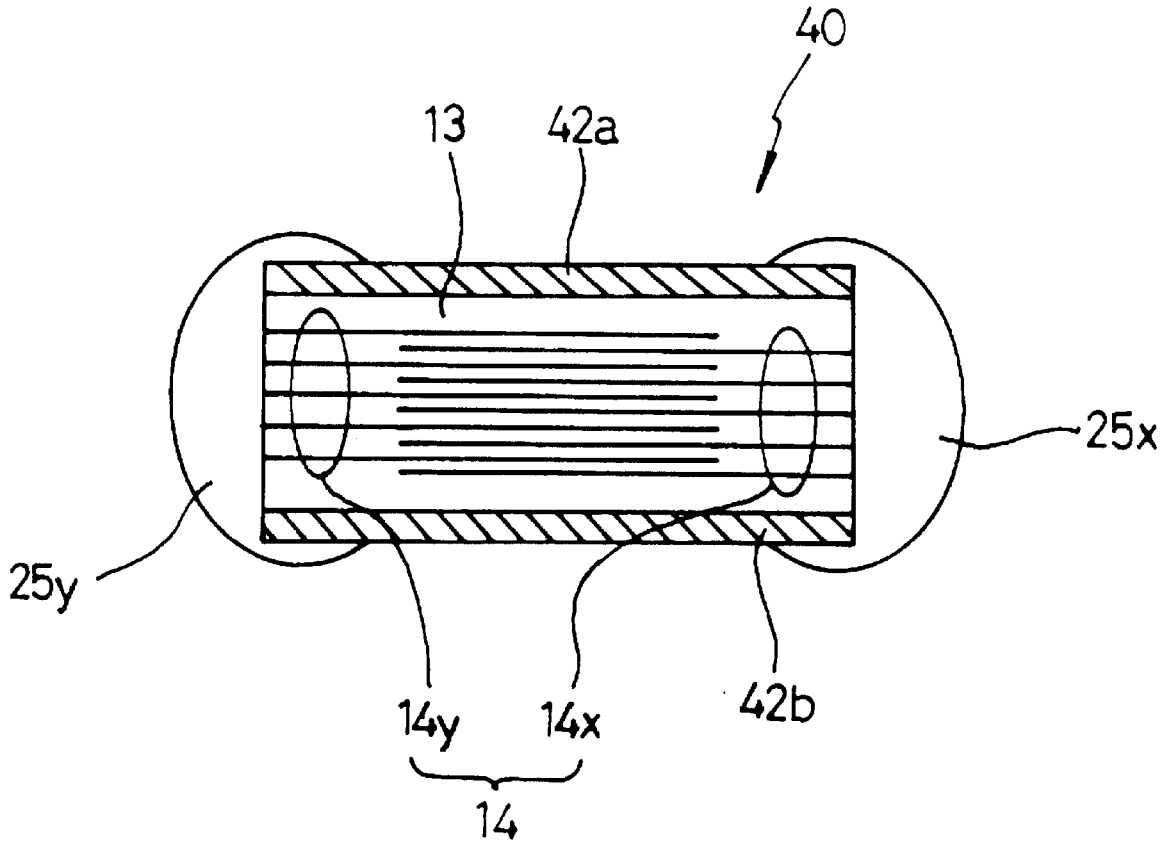
FIG. 7 is a sectional view showing a chip-type varistor obtained by a third embodiment of the present invention.

FIG. 7 is a sectional view of a varistor obtained according to the third embodiment of the present invention. In the case of the chip type varistor 40, a fabricated varistor chip is not used in the chip type varistor 40, differently from the first and second embodiments, but a glass coating film is coated on the surface of the chip during performing a varistor chip fabrication process.

For this purpose, first of all, different green tapes are fabricated and cut. Then, a conductive paste is used to perform a pattern printing in order to form the inner electrodes 14*x* and 14*y*. Then, a glass-added sheets 42*a* and 42*b* to be used as cover sheets are fabricated.

The glass-added sheets 42*a* and 42*b* are prepared by casting a tape of 30–100 $\mu$m thick with a doctor blade method using a slurry in which glass of 0.1–10 w % is added.

Then, the inner electrode layer in which a number of inner electrode patterns are printed is collated and stacked. Post-processes of the varistor chip are performed at the state where the glass-added sheets 42*a* and 42*b* are used as cover sheets as shown in FIG. 7 and stacked.

That is, the stacked inner electrode layer and the glass-added sheets 42*a* and 42*b* are compressed and then undergone a chip cutting process, to then execute a binder burn-out and cofiring.

When the firing process is performed, glass starts to molten at first due to a low melting temperature of the glass component in the glass-added sheets 42*a* and 42*b*, and the liquified glass surrounds ZnO of the ceramic body 13 and the other components to thus perform a liquid phase sintering process.

Here, the glass component has a high insulation resistance inherently, and is collected toward a grain boundary which is a leakage current path, to thereby allow a glass coating film to be coated on the surface of the chip. As a result, the glass coating film is formed on the chip surface. Thus, erosion of the grain boundary due to the flux is suppressed to thereby prevent lowering of the insulation resistance.

Then, after undergoing a tumbling process, the outer electrode terminals 25*x* and 25*y* are formed. If the electrodes are fired, the varistor 40 of FIG. 7 is obtained.

The glass-added sheets 42*a* and 42*b* forming the cover sheet layers have no influences on the features of the varistor 40. During sintering, the surface of the varistor is protected by glass, to thereby suppress erosion due to the flux and prevent lowering of the insulation resistance.

After a varistor having a glass coating film formed according to each of the first and second embodiments of the present invention, and a conventional varistor are soldered on a PCB, respectively, respective insulation resistance values are measured. In case of the conventional varistor, an average resistance of 2.11 Mω has been measured. In the case that glass is added in the paste according to the first embodiment, to thereby form a coating film, a resistance of 865.00 Mω has been measured. In the case that a glass coating film is formed according to the second embodiment, a resistance of 2744.50 Mω has been measured. As a result, in the case of the present invention structure, an initial resistance value (approximately 1000 Mω) is nearly maintained or reveals an improved insulation function.

Meanwhile, the examples of forming the glass coating film on the chip-type varistor have been described in the embodiments. However, the present invention can be also applied to the case that a glass coating film is formed on the surface of a general chip-type passive device having an insulation resistance reduction property similar to that of the chip-type varistor.

As described above, in the present invention, a coating film having an excellent acid-resistant property is formed on the surface of the chip-type device, to thus prevent erosion of the chip-type varistor due to an activated liquified flux at the time of reflow soldering. As a result, an influence of the flux can be excluded to thereby maintain a high initial insulation resistance value.

Also, the glass coating film protects the surface of the chip-type varistor from a plating solution during plating, to thereby remove a bridging phenomenon.

As described above, the present invention has been described with respect to the particularly preferred embodiments thereof. However, the present invention is not limited to the above embodiments, but various modifications and corrections can be possible by one who has an ordinary skill in the art without departing off the spirit of the present invention and within the technical scope of the appended claims.

What is claimed is:

1. A method for fabricating a chip-type varistor having a glass coating layer, the chip-type varistor fabrication method comprising the steps of:

(a) providing a varistor chip with a number of conductive pattern layers stacked between upper and lower portions of a ceramic body, the conductive pattern layers being spaced by a predetermined distance, and stackwise alternating ones of the conductive pattern layers being laterally withdrawn from alternating ends of the ceramic body to respectively form first and second inner electrodes;

(b) etching outer surfaces of the ceramic body with a weak acid solution;

(c) forming a first outer electrode at each end of the varistor chip so as to be electrically connected to the first and second inner electrodes, respectively;

(d) forming a polymeric mask on an outer end of each of the first outer electrodes for preventing glass from penetrating into the first and second inner electrodes, respectively;

(e) dipping each of the first outer electrodes into a glass-added paste;

(f) forming a uniform glass coating layer by flowing the glass included in the glass-added paste from the dipped first outer electrodes directly onto the surface of the ceramic body by a thermal treatment, the thermal treatment being one of sufficient heat to perform the glass flowing and to simultaneously remove a face portion of the polymeric mask so as to expose the first outer electrodes; and (g) forming a second outer electrode surrounding a corresponding one of the first outer electrodes, at each end of the chip.

2. The chip-type varistor fabrication method of claim 1, wherein the glass-added paste is made of adding any one of $SiO_2$+RO, $B_2O_3$+RO and $SnO_2$+RO by 0.1–100 wt % to any one metal powder among Ag, Ag/Pt, Ag/Pd, Ag/Pd/Pt, Ag/Au and Ag/Au/Pt, in which RO is made of a mixture of one through five kinds of materials selected from the group consisting of PbO, $Bi_2O_3$, $SiO_2$, $Al_2O_3$, ZnO, $P_2O_5$, MgO, $Na_2O$, BaO, CaO, $K_2O$, SrO, $Li_2O$, $TiO_2$, $ZrO_2$, $V_2O_5$ and $SnO_2$.

3. The chip-type varistor fabrication method of claim 1, wherein the outer electrode formation step comprises the steps of preliminarily forming the first and second outer electrodes using a paste made of metal powder of 91–96 wt %, binder of 3 wt %, and glass of 1–5 wt %; and thermally treating the preliminary formed outer electrodes at 600–800° C.

4. A method for fabricating a chip-type varistor having a glass coating film, the chip-type varistor fabrication method comprising the steps of:

(a) providing a varistor chip with a number of conductive pattern layers stacked between upper and lower portions of a ceramic body, the conductive pattern layers being spaced by a predetermined distance, and stackwise alternating ones of the conductive pattern layers being laterally withdrawn from alternating ends of the ceramic body to respectively form first and second inner electrodes;

(b) dipping the varistor chip into a weak acid solution to thereby form a number of pores on the surface of the ceramic body;

(c) dipping the varistor chip into a glass slurry formed of glass powder;

(d) rotating and drying the chip so as to directly coat the surface of the ceramic body with a uniform layer of the glass slurry;

(e) thermally treating the glass slurry coated chip to thereby melt the glass into the pores on the ceramic body surface so as to form a uniform glass coating layer by a capillary phenomenon; and (f) forming respectively first and second outer electrodes surrounding the glass coating layer corresponding to the first and second inner electrodes.

5. The chip-type varistor fabrication method of claim 4, wherein the glass slurry comprises powders of $SiO_2$, $Al_2O_3$, CaO, $Na_2O$, $B_2O_3$ and PbO.

6. The chip-type varistor fabrication method of claim 4, wherein the outer electrode formation step comprises the steps of preliminarily forming the first and second outer electrodes using a paste made of metal powder of 91–96 wt %, binder of 3 wt %, and glass of 1–5 wt %; and thermally treating the preliminary formed outer electrodes at 600–800° C.

7. The chip-type varistor fabrication method of claim 4, wherein the step of processing the thickness of the glass slurry coated on the chip surface uniformly is processed by using a dry ball mill drive.

* * * * *